US007632390B2

(12) United States Patent
Rokicki

(10) Patent No.: US 7,632,390 B2
(45) Date of Patent: Dec. 15, 2009

(54) APPARATUS AND METHOD FOR ENHANCING ELECTROPOLISHING UTILIZING MAGNETIC FIELDS

(76) Inventor: Ryszard Rokicki, 5657 Fox La., Emmaus, PA (US) 18049

( * ) Notice: Subject to any disclaimer, the term of this patent is extended or adjusted under 35 U.S.C. 154(b) by 623 days.

(21) Appl. No.: 11/009,190

(22) Filed: Dec. 10, 2004

(65) Prior Publication Data

US 2006/0124472 A1 Jun. 15, 2006

(51) Int. Cl.
*B23H 3/00* (2006.01)

(52) U.S. Cl. ..... 205/640; 205/646

(58) Field of Classification Search ..... 204/252; 205/646, 640

See application file for complete search history.

(56) References Cited

U.S. PATENT DOCUMENTS 5,240,569 A 8/1993 Waldron
6,203,689 B1 * 3/2001 Kim et al. ..... 205/652
6,890,670 B2 * 5/2005 Leddy et al. ..... 428/553
2004/0131889 A1 * 7/2004 Leddy et al. ..... 428/694 B
2006/0005900 A1 * 1/2006 Dorfman ..... 148/400

OTHER PUBLICATIONS

Carpino et al. "Quadrupole magnetic field-flow fractionation for the analysis of magnetic nanoparticles" Journal of Physics: Conference Seriers 17 (2005) pp. 174-180.*

* cited by examiner

*Primary Examiner*—Nam X Nguyen
*Assistant Examiner*—Dustin Q Dam
(74) *Attorney, Agent, or Firm*—Sanford J. Piltch, Esq.

(57) ABSTRACT

A process for electropolishing metals and metalloids and their alloys, intermetallic compounds, metal-matrix composites, carbides and nitrides in an electrolytic cell utilizing an externally applied magnetic force to enhance the dissolution process. The electropolishing process is maintained under oxygen evolution to achieve an electropolished surface of the work piece exhibiting reduced microroughness, better surface wetting and increased surface energy, reduced and more uniform corrosion resistance, minimization of external surface soiling and improved cleanability in shorter time periods.

11 Claims, 2 Drawing Sheets

APPARATUS AND METHOD FOR ENHANCING ELECTROPOLISHING UTILIZING MAGNETIC FIELDS

BACKGROUND OF THE INVENTION

The present invention relates to the field of electropolishing and, more specifically, to the electropolishing process carried out with an externally applied uniform magnetic field to alter the properties of the electropolished surfaces. This inventive process, magnetoelectropolishing, is carried out using an electropolishing bath composed of a processing tank, a dc power supply, electrodes and connecting wiring, and a controller. The material for electropolishing is selected, uniform magnetic fields are created or formed about the position to be taken by the selected material in the processing tank by using either permanent magnets or electromagnets, and the control parameters are selected for the electropolishing process, i.e., length of time, voltage level, solution temperature. The electropolishing process parameters are met and the time period is completed before the externally applied magnetic field is removed.

The effects of applying an external magnetic field on an electrochemical reaction can be divided into three categories: electron transfer; mass transfer (Lorenz Force]; and, morphology and chemistry of the treated material surface subsequent to dissolution. Electropolishing, a controlled anodic dissolution, is one example of electrolysis. To establish optimum conditions for electropolishing a particular metal, metal alloy, etc., a voltage vs. current curve is plotted and plateau current densities are established. The current densities plateau mainly exists just below the oxygen evolution regime. However, for many metals, metal alloys, etc., the best electropolishing results may be obtained beyond this plateau under oxygen evolution conditions. The best example is a most often industrially used process for electropolishing stainless steels, which are carried out under an oxygen evolution regime.

Electron transfers in electrochemical reactions occur naturally, i.e. corrosion process, or can be induced artificially. Electropolishing by controlled anodic dissolution is an example of the latter. The electron transfer between the electropolished material and the electrolyte solution must occur for the process to work. To obtain the required conditions the potential differences need to be established between anodes and cathodes, which in almost all cases of electropolishing processes is done by applying direct current.

The best way to describe the electron transfer process between an electrolyte and a solid electrode is the energy level model. In metals, from the electrochemist approach, there exists an electrochemical potential of electrons in a metal electrode, i.e. the Fermi level. In an electrolyte three energy levels exist: $E_{OX}$, $E_{RED}$ and $E_{REDOX}$. The characteristic of any solid depends on the extent to which the electron orbitals in the highest band are filled. The extent to which the highest orbitals are filled is called the Fermi level. In metals, the highest band of electron orbitals is only partially filled with electrons and these electrons can jump from one state to another with only an infinitesimal change in energy. This characteristic makes metals good electrical and thermal conductors.

In the case of electrolysis processes, when the applied electrical potential begins a redox reaction with the cathode lying along a central vertical axis, the work piece anode surrounding the cathode and the magnetic field surrounding the electrolysis cell, the external magnetic field alters the process most probably by interfering with the electron structure (Fermi level), resulting in the modification of the polarization of the free surface electrons. Further, no one can exclude the possibility of a proton transfer reaction influenced by the magnetic field that can be important both in the presence and absence of electron transfer processes.

SUMMARY OF THE INVENTION

In the last two decades, the electropolishing process seems to have been rediscovered mainly due to the significantly increased demand for super clean (by metallurgical standards), homogeneous, corrosion resistant, biocompatible surfaces that do not interfere in processes utilized by semiconductor, biotechnology, pharmaceutical and human implant industries. The main group of electropolished alloys is austenitic stainless steels, mainly alloys 304, 304L, 316 and 316L. Specialty stainless steel alloy 316L and its medical grade are used extensively in pharmaceutical, semiconductors and body implants due to its superior corrosion resistance, smoothness, biocompatibility and cleanability after electropolishing treatment. The remarkable improvement in corrosion resistance of electropolished surfaces of austenitic stainless steels are caused by several interconnected events occurring during the electropolishing process. The first of these is the removal of the Beilby layer that consists of inclusions of martensitic phase, foreign material, preexisting oxides, etc, created by forming, machining and mechanically polishing. The second is to create a new corrosion resistant layer that is enriched in chromium oxide due to the anomalous co-dissolution of austenitic steels. The third is to improve the surface smoothness by dissolving the surface picks preferentially to the surface depressions. The fourth event is the equipotentializing of grain boundaries on metallic materials.

In the electronics industry electropolishing is used for silicon wafers, with metal carbides and nitrates also being electropolished. Less often the electropolishing process is applied to pure metals such as Titanium [Ti] or Tantalum [Ta] to improve their self-passivated surfaces, Niobium [Nb] in semi-conducting cavities devices, and Copper [Cu] film for planarization of electronic devices. The electropolishing process is also utilized for the surface enhancement of intermetallic materials like Nitinol [NiTi] that is more often used in human implant devices.

A very special niche market in which electropolishing has become extremely important is the human implant industry where metallic devices have surface features that require super critical refinement to be compatible with the human physiologic system. The principal metallic materials used to produce such devices are 316L medical grade stainless steel, cobalt-chromium-nickel, low nickel cobalt-chromium alloys, Ti, Zirconium [Zr], Ta and its alloy, and intermetallic NiTi (Nitinol—memory alloy). In order to significantly improve the biocompatibility, corrosion resistance and other properties of these metallic materials they are, in most cases, electropolished.

The use of externally applied magnetic fields to the electropolishing process provides the supercritical refinement of surface properties to the new high level required for medical implant devices as discussed above. The addition of the external magnetic field also drastically minimizes microtopography by lowering microroughness and minimizing actual surface area in micro and nano scales of the various metallic materials. From a practical point of view the more important features of influence of a magnetic field used during an electropolishing process are the alteration of morphology and chemistry of the finished surface. The main reason for utilizing an electropolishing process is to improve the quality of the electropolished surface and the incorporation of a magnetic field during the electropolishing process provides an enhanced opportunity to accomplish the desired results.

The only prior patent reference that specifically describes the use of a magnetic field for use in the electropolishing (dissolution) process is U.S. Pat. No. 6,203,689 [Kim, et al.], which mentions the use of a magnetic field to promote electrolysis by activating electrolyzed ions by the Lorenz force effect. The Kim patent describes the use of a plurality of magnets arranged around the electrolysis cell and moving in combination with the electrode into and out of the described deep hole or well in the article to be electropolished. With the use of the magnets a magnetic field is formed in a zone including the article, but there is no suggestion or teaching under which oxygen regime the electropolishing was performed, what type of materials were electropolished, or whether the apparatus is limited only to the "deep-hole" polishing as described in the reference.

The invention resides in the process for the enhanced electropolishing of metals and metalloids and their alloys, intermetallic compounds, metal-matrix composites, carbides and nitrides in an electrolytic cell for initiating and maintaining the dissolution of minute particles from the surface of the material to be electropolished for a predetermined period of time. The improvement in the electropolishing process is the utilizing of an externally applied magnetic force surrounding the electrolytic cell and establishing a uniform magnetic field therein sufficient to surround and encompass the cathode and the anode work piece. The application of an external magnetic field is coupled with the process being controlled and maintained under oxygen evolution to achieve an electropolished surface of the work piece exhibiting reduced microroughness, better surface wetting and increased surface energy, reduced and more uniform corrosion resistance, minimization of external surface soiling and improved cleanability.

The enhanced electropolishing process includes metals selected from the group consisting of Ag, Al, Au, Be, Bi, Cd, Co, Cr, Cu, Gd, Hf, In, Ir, Mg, Mn, Mo, Nb, Ni, Os, Pd, Pt, Pu, Re, Rh, Sn, Ta, Th, Ti, TI, U, V, W, Y, Zn, and Zr. The process also includes metalloids selected from the group consisting of Si and Ge. and intermetallic compounds selected from a group consisting of materials comprising two or more elemental metals of defined proportions. The process further is applicable to metal-matrix composites selected from a group consisting of materials comprising continuous carbon, silicon carbide or ceramic fibers that are embedded in a metallic matrix. The process is also applicable to electropolishing carbides selected from a group consisting of a compound comprising carbon and one or more metallic elements and nitrides selected from a group consisting of a compound comprising nitrogen and one or more metallic elements.

The externally applied magnetic force for use with the enhanced electropolishing process may be selected from a group consisting of either permanent magnetic or electromagnetic devices and these materials may be formed from rigid or flexible magnetic materials. It will be exhibited that the enhanced electropolishing process will result in a better enhanced surface result from the electrodissolution when the externally applied magnetic force ranges between 0.1 T and 1.0 T and the process is maintained under the oxygen evolution regime.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
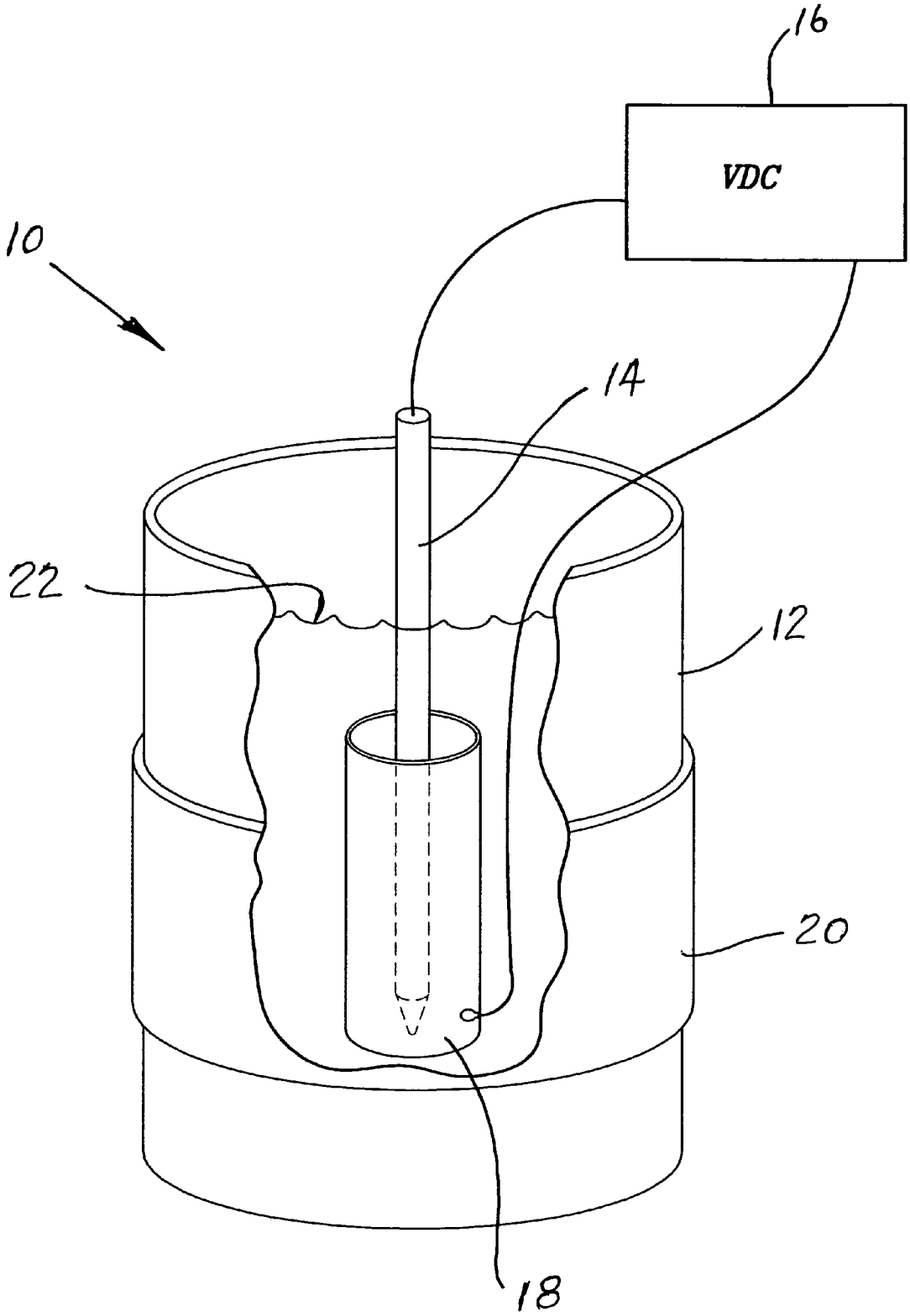
FIG. 1 is a partially cutaway view of an electrolysis cell with a flexible permanent magnet surrounding the outer cell wall.

Referring now to the drawings in detail, where like numerals refer to like parts or elements, there is shown in FIG. 1 an electrolysis cell 10. The cell 10 is comprised of a cylindrically shaped vessel 12 within which a cathode 14 extends downward along a vertical axis at the approximate center. The cathode 14 is connected by a wire to a voltage source 16 that can produce a desired level of dc voltage. The voltage source 16 is also connected to the work piece anode 18 at a point distant from the point of voltage connection to the cathode 14. The work piece anode 18 in this example is shaped as a hollow cylinder with the cathode 14 positioned through its central axis. Surrounding the vessel 12 and extending vertically a distance similar to the length of the work piece anode 18 is a flexible permanent magnet 20 that creates a magnetic field having substantially equal strength across its width and extending into the vessel 12 to the cathode 14. The cathode 14 and work piece anode 18 are submerged in an electrolytic solution 22 selected to achieve the enhanced desired result of electrolytic dissolution of the surface area of the work piece anode 18. In the electrolytic cell 10 of FIG. 1, the surface of the work piece anode 18 that will be magnetoelectropolished is the interior surface of the cylindrical work piece, i.e., the surface juxtaposed to the cathode 14.

Figure 2:
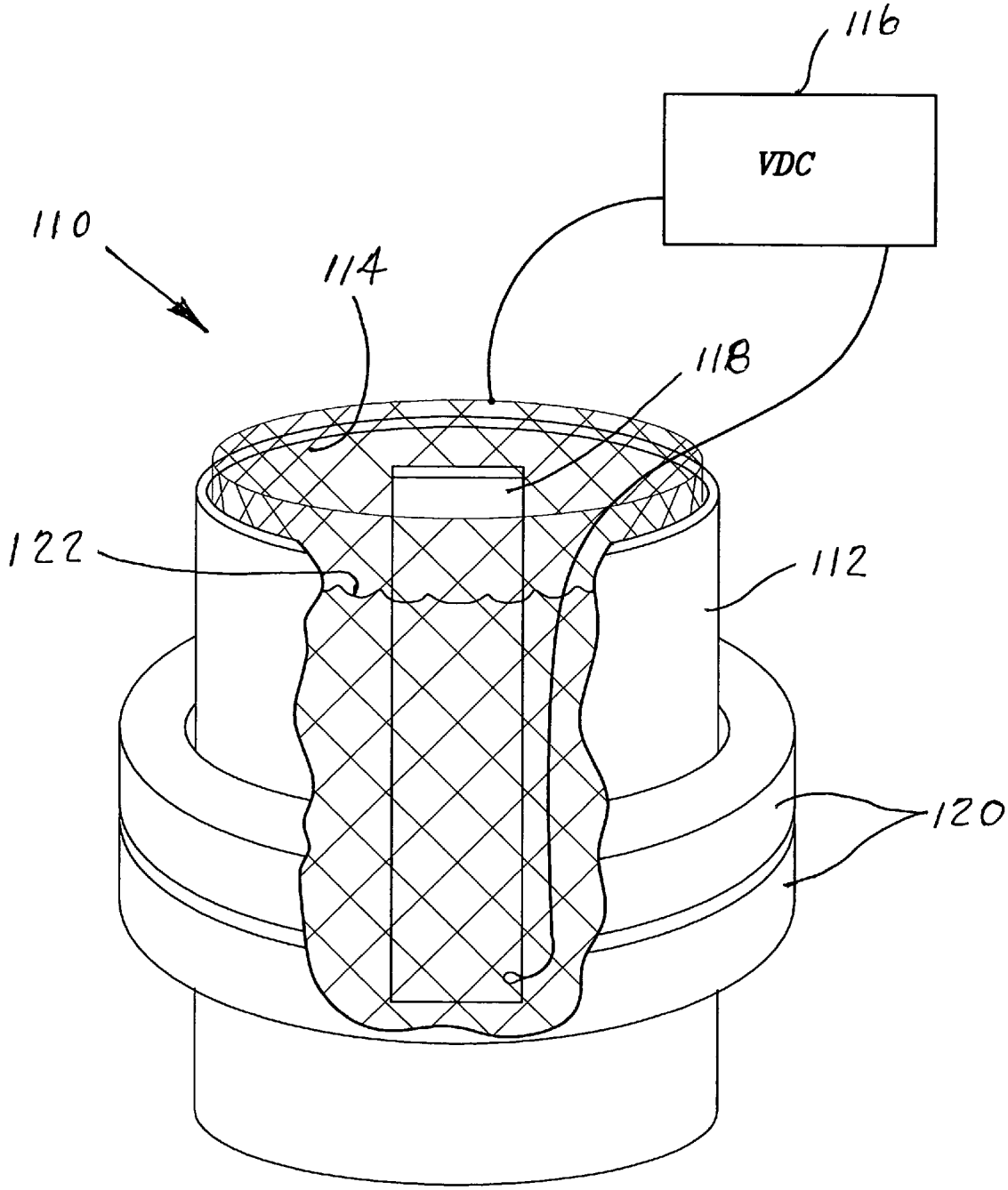
FIG. 2 is a partially cutaway view of an electrolysis cell having a different arrangement of cathode and anode with a plurality of concentric ring magnets surrounding the cell.

An alternative embodiment for an electrolysis cell 110 is shown in FIG. 2. The cell 110 is also comprised of a cylindrically shaped vessel 112 within which a differently shaped cathode is positioned circumferentially around the inner wall of the vessel 112. The cathode 114 is configured as a mesh screen and is connected by a wire to a voltage source 116, nominally providing a dc voltage appropriate for the material and conditions. The voltage source 116 is also connected to the work piece anode 118 at a point distant from the point of voltage connection to the cathode 114. The work piece anode 118 in this embodiment is shaped as a flat rectangular plate and is positioned at the approximate co-central axis of the cathode 118 and the vessel 112. Surrounding the vessel 112 and extending vertically a distance similar in the length to the length of the work piece anode 118 are a plurality of concentric ring permanent magnets 120 that create a magnetic field having substantially equal strength across their combined width and extending into the vessel 112 to the work piece anode 118. In this example two ring magnets are shown, but a greater number could also be used, the number depending upon the extent of the effect of the magnetic field fully encompassing each and every dimension of the work piece anode 118. The cathode 114 and work piece anode 118 are submerged in an electrolytic solution 122 selected to achieve the enhanced desired result of electrolytic dissolution of the surface area of the work piece anode 118. In the electrolytic cell 110 of FIG. 2, the surface of the work piece anode 118 that will be magnetoelectropolished is the exterior surface of the flat rectangular work piece, i.e., the surface juxtaposed to the cathode 114.

In electropolishing processes, an externally applied magnetic field works in two distinctive ways; by enhancing or retarding the rate of the dissolution process. The change in rate or speed of the process does not depend on either the magnetic properties of the material or the composition of the electrolyte. The main factor, which has not been earlier reported as being responsible for the two-way influence of externally applied magnetic fields on the electropolishing process, is created by the oxygen regime. When electropolishing is performed with a constant potential under oxygen evolution the current densities decrease and less material is dissolved. The rate of retarding the process depends upon the strength of the externally applied magnetic field. On the other hand, when electropolishing is carried out under a constant potential below oxygen evolution, current densities are increased and the material removal rate is enhanced. The rate of dissolution of electropolished material using the same constants also depends upon the strength of the magnetic field, but with the opposite result. The increase in the strength of the magnetic field speeds up the rate of dissolution.

Another factor that has some, but not as predominant an influence on the rates of dissolution is the orientation of the magnetic field. To determine the influence of the orientation of the magnetic field on dissolution rates electropolishing experiments were performed on two identical samples of Nb wire having a 1 mm diameter and being 10 mm in length. The electropolishing was performed below the oxygen evolution regime with identical parameters and conditions, excepting the orientation of the externally applied magnetic field of 0.5 T. The orientation of the magnetic field for sample 1 was parallel to the length dimension of the wire and for sample 2 was perpendicular to length dimension of the wire. The mass loss for the two samples were as follows:

| | |
|---|---|
| Sample 1 of Nb wire with parallel magnetic field | −0.00681 g |
| Sample 2 of Nb wire with perpendicular magnetic field | −0.00613 g |

The minimal difference in mass loss between the two samples indicates that orientation of the magnetic field plays some role in the rate of dissolution, but not a very significant one.

Although the origin of the two-way influence of externally applied magnetic fields on electropolishing processes is not fully understood and requires a good deal of further research and clarification, one possible explanation of the effect can lie in the properties of the oxygen molecule and its behavior in a magnetic field. Oxygen is a paramagnetic species with two unpaired electrons that are attracted and aligned by magnetic fields. Some oxygen [$O_2$] molecules are released and escape from the dissolution layer during decomposition of oxides while other molecules are attracted by the existence of magnetic fields and adsorb dissociatively on the cyclically oxidized surfaces. The dissociatively adsorbed oxygen must be responsible for the decrease of current density and by this for the rate of dissolution of electropolished materials.

Another factor that has been considered as having some effect on electropolishing of metals is the Lorenz force. The effect of the Lorenz force on electrochemical reactions has been studied for several decades, but the mechanisms involved are still not completely understood. The Lorenz force is a cross product of magnetic field and current. The mechanical effect of the Lorenz force during electrolysis is the rotating of the electrolyte around the axis parallel to the magnetic field. The movement of the electrolyte by this force reduces the thickness of the diffusion layer that theoretically, as well as practically, in the cases of electrodeposition processes, enhances the electrodeposition rate.

In the case of electropolishing, a controlled anodic dissolution process, the influence of the Lorenz force is more complex. When electropolishing is performed using a constant potential within an externally applied magnetic field, and such process is carried out under oxygen evolution conditions, the influence of the Lorenz force seems to work against the most recognized diffusion theory of electropolishing. The thinning of the diffusion layer by the Lorenz force, which circulates electrolyte around the electropolished material (anode), should increase the current density and more material should be dissolved. This theory contradicts the experimental data that has produced conflicting results.

TABLE I reflects two sets of experiments of a comparison of the mass loss of metals, metal alloys and intermetallic compounds under the influence of a 0.5 T magnetic field using two different electropolishing regimes. In the first set of experiments, designated with the superscript 1, the dissolution process was conducted under an oxygen evolution regime. In the second related experiment, designated with the superscript 2, the dissolution process was conducted below the oxygen evolution regime. In both cases the dissolution processes were conducted using appropriate electrolyte solutions under conditions suitable for achieving the desired electropolished finish.

TABLE I

| MATERIAL | SURFACE AREA $cm^2$ | INITIAL MASS Grams (g) | MASS LOSS of standard electropolished samples in Grams (g) | MASS LOSS of electropolished samples in magnetic field of 500 mT in Grams (g) |
|---|---|---|---|---|
| 316 L stainless steel[1] | 0.540 | 0.1586 | 0.0356 | 0.0210 |
| Ni 200[1] | 0.786 | 0.3534 | 0.0858 | 0.0396 |
| Brass[1] | 0.828 | 0.3827 | 0.0161 | 0.0097 |
| Copper[1] | 0.698 | 0.2636 | 0.0128 | 0.0051 |
| NiTl (Nitinol)[1] | 0.298 | 0.0419 | 0.0027 | 0.0015 |
| 316 L stainless steel[2] | 0.540 | 0.1586 | 0.0159 | 0.0324 |
| Nb[2] | 0.329 | 0.0672 | 0.0075 | 0.0165 |
| Ti[2] | 0.329 | 0.0354 | 0.0040 | 0.0072 |
| Ta[2] | 0.329 | 0.1307 | 0.0146 | 0.0306 |

One can readily see that the mass loss of the electropolished samples is increased using a magnetic field and conducting the dissolution process below the oxygen evolution regime. Thus, the agitation of electrolytic solutions occurring with the Lorenz force may be unnecessary in dissolution processes.

Even in high rotation speed experiments, up to 33,000 rpm, where it will be very hard to find a diffusion layer, or the diffusion area will be reduced to several nanolayers, electropolishing of some material can still be achieved, for example 316L stainless steel. In this case the Lorenz force created by 0.5T magnetic field is totally negligible, but still the influence of the magnetic field is apparent by the reduced current density and the lesser amount of electropolished material dissolved. In the case of constant potential electropolishing carried out below the oxygen evolution condition the influence of the Lorenz force is less problematic and can play some role in speeding up dissolution of the electropolished material.

TABLE II shows the mass loss and transmittance of electrolyte after potentiostatically-controlled electropolishing of 316L stainless steel samples under oxygen evolution regime. The same electropolishing conditions and parameters were maintained for the tests reflected in TABLE II including the anode surface area of 0.379 cm2, voltage potential of 10 volts dc, electrolyte temperature of 145° F. and time of process at 180 seconds.

TABLE II

| Magnetic Field mT | Mass Loss in Grams (g) | Transmittance 520 nm | Mass Loss in % |
|---|---|---|---|
| 0 | 0.0298 | 61.8 | 36.48 |
| 25 | 0.0254 | 69.2 | 31.09 |
| 50 | 0.0248 | 70.0 | 30.36 |
| 100 | 0.0244 | 71.5 | 29.87 |
| 250 | 0.0221 | 73.2 | 27.06 |
| 500 | 0.0146 | 79.3 | 17.88 |

Other benefits from electropolishing in a magnetic field that are empirically proven for 316L stainless steel and discussed in the following examples are: 1) alternated surface energy indicated by a change in contact angle; 2) enhanced pitting and uniform corrosion resistance in high Chloride [$Cl^-$] concentrated solution; 3) halted Nickel [Ni] ion leakage in high Chloride [$Cl^-$] concentrated solution; 4) shifted ECORR (corrosion potential) to the more positive direction; 5) creation of a more homogeneous oxide; and, 6) drastic minimization of soiling after contact with body fluids, i.e., saliva, blood, urine, etc.

There are a number of tests that were undertaken to establish the theoretical results of the invention. The first of these was to measure the contact angle of the work piece for electropolishing when subjected to a magnetic field. The contact angle may be described as the tangent angle existing between a water droplet and the adjacent surface of the work piece. The smaller the contact angle, the better wetting effect and the higher the surface energy (dynes/cm) of the work piece. In this test, two samples of 316L stainless steel rounds, 18.35 mm in diameter, were punched from the same sheet of material. Each piece was sanded with 1000 grid and then by 2000 grid sandpaper to a mirror finish. Both samples were electropolished using the identical conditions of electrolyte, voltage, time, temperature, anode to cathode ratio and configuration of the electropolishing cell, except that one sample was subjected to a magnetic field of 0.5T during the electropolishing process. Visual examination and microscopic examination (100X) of the samples revealed very satisfactory finishes without any noticeable differences. The contact angle of the samples was measured following the several time intervals of the electropolishing process with the results shown in TABLE III below.

TABLE III

| TIME [Seconds] | ELECTROPOLISHED [Standard Process] | ELECTROPOLISHED [0.5 T Magnetic Field] |
|---|---|---|
| 0 | 82.9186 | 64.1037 |
| 30 | 79.9252 | 59.2308 |
| 60 | 79.3238 | 58.3663 |
| 90 | 78.5034 | 56.9019 |

As shown in TABLE III, the contact angle of the sample that was electropolished in the 0.5 T magnetic field decreased 25.6% making the surface more hydrophilic.

The next test performed was for Ni leakage. Again, two 316L stainless steel samples were prepared exactly in the same way as described above with the total surface area of each sample being 600 $mm^2$. The samples were immersed for 14 days in 0.75 N HCl (hydrochloric acid) solution in separate plastic beakers. At the end of the test the concentration of Nickel was measured calorimetrically. For the sample electropolished in a magnetic field Ni ions were not detected, but the standard electropolished sample exhibited a leakage of Ni of 0.0064 mg. It should also be noted that there were differences in the states of each sample, and in the corroding medium, which were visible to the naked eye. The magneto-electropolished sample remained very shiny and the corroding medium remained clear and transparent. However, the sample subjected to standard electropolishing lost its shininess and the solution turned greenish.

The next test was to measure the ECORR (corrosion potential) to determine which of the processes would provide the better corrosion resistance. The corrosion potential was measured in a 0.9% Sodium Chloride [NaCl] solution. After one hour at equilibrium each of the two 316L stainless steel samples, prepared as described above with one subjected to a standard electropolishing process and the other subjected to the magnetic field during electropolishing, the ECORR was measured. The exposed surface area of the two samples to the electrolyte was 147.41 $mm^2$ for each sample. The measurement taken was of the ECORR potential versus silver chloride [AgCl] in millivolts. For the sample subjected to the standard electropolishing process the ECORR potential was −0.025 mv. The sample that was magnetoelectropolished, i.e., subjected to the magnetic field, the ECORR potential was found to be 0.001 mv. Thus the use of the magnetic field provided a better ECORR potential and better corrosion resistance.

The final test was to determine the best way to reduce blood soiling, or adhesion of the body fluid, to metallic surfaces. The test was designed to determine the adhesion, or surface retention, of whole human blood to the metallic surfaces of the two samples. As before, two samples of 316L stainless steel were prepared identically as described, each sample to be used in a blood clotting (thromboresistance) experiment. Following the subjecting of the first sample to a standard electropolishing process and the second sample to a magnetoelectropolishing process, each sample had deposited on a surface 0.1 ml of freshly drawn human blood. After a thirty minute period of permitted coagulation each sample was transferred to a separate glass beaker each containing 20 ml of distilled water and the coagulated blood spots on the sample surfaces were permitted to hemolyze for ten minutes. The released hemoglobin from the coagulated blood spots dispersed in the distilled water and the resulting solution was measured calorimetrically. The concentration of freed hemoglobin from the coagulated blood spots was measured using a spectrophotometer having a transmittance at 520 nm. The transmittance of the solution containing the hemoglobin from the magnetoelectopolished sample was 27% lower than the freed hemoglobin level of the sample subjected to a standard electropolishing process without a magnetic field. The test results bear out that the electropolished metallic surface subjected to a magnetic field during electropolishing better resisted soiling of, or adhesion to the surface by whole blood than did the sample subject to only standard electropolishing.

The addition of a substantially uniform external magnetic field surrounding the electrolysis cell, and retaining the electrolytic reaction under the oxygen evolution regime, will produce the desired results of the changes in the surface properties of the electropolished metal, metal alloy and intermetallic compounds so that they may be utilized in the very specialized areas of human implants, e.g. intravascular devices such as stents and pacemaker electrodes, and in highly specialized electronics applications requiring much better wetting and increased surface energy, significant reduction in and more uniform corrosion resistance, and minimization of external surface soiling due to human body fluids or other despoiling agents.

It should be understood that the invention described above is but one method of utilizing a magnetic field to enhance the resulting surface properties of an electropolished work piece. Altering the strength, orientation and direction of the magnetic field applied to the electrolytic cell may be done by one skilled in the art without departing from the essential scope of the invention. Further, the present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A process for the enhanced electropolishing of metals and metalloids and their alloys, intermetallic compounds, metal-matrix composites, carbides and nitrides in an electrolytic cell having an anodic work piece, a cathode, and a cylindrical chamber for initiating and maintaining the dissolution of minute particles from the surface of the material to be electropolished for a predetermined period of time utilizing an externally applied magnetic force from a magnet continuously extending around and circumscribing the electrolytic cell and establishing a uniform magnetic field therein sufficient to surround and encompass the cathode and the anodic work piece, said process being maintained under oxygen evolution with an electropolished surface of the work piece exhibiting reduced microroughness, better surface wetting and increased surface energy, reduced and more uniform corrosion resistance, minimization of external surface soiling and improved cleanability.

2. The process according to claim 1 wherein the metal is selected from the group consisting of Ag, Al, Au, Be, Bi, Cd, Co, Cr, Cu, Gd, Hf, In, Ir, Mg, Mn, Mo, Nb, Ni, Os, Pd, Pt, Pu, Re, Rh, Sn, Ta, Th, Ti, Tl, U, V, W, Y, Zn, and Zr.

3. The process according the claim 1 wherein the metalloid is selected from the group consisting of Si and Ge.

4. The process according to claim 1 wherein the intermetallic compound is selected from a group consisting of materials comprising two or more elemental metals of defined proportions.

5. The process according to claim 1 wherein the metal-matrix composite is selected from a group consisting of materials comprising continuous carbon, silicon carbide or ceramic fibers that are embedded in a metallic matrix.

6. The process according to claim 1 wherein the carbide is selected from a group consisting of a compound comprising carbon and one or more metallic elements.

7. The process according to claim 1 wherein the nitride is selected from a group consisting of a compound comprising nitrogen and one or more metallic elements.

8. The process according to claim 1 wherein the magnet may be selected from a group consisting of permanent magnets or electromagnetic apparatus.

9. The process according to claim 8 wherein the selected magnet may be formed from rigid or flexible magnetic materials.

10. The process according to claim 1 wherein the externally applied magnetic force ranges between 0.1T and 1.0T.

11. The process according to claim 1 including the additional steps of first terminating the electrochemical process in the electrolytic cell and then removing the uniform magnetic field from around the electrolytic cell.

* * * * *